US007282114B1

(12) United States Patent
Kankaanpää

(10) Patent No.: US 7,282,114 B1
(45) Date of Patent: Oct. 16, 2007

(54) METHOD FOR PROCESSING PULP

(75) Inventor: Veikko Kankaanpää, Valkeakoski (FI)

(73) Assignee: Metso Paper, Inc., Helsinki (FI)

( * ) Notice: Subject to any disclaimer, the term of this patent is extended or adjusted under 35 U.S.C. 154(b) by 391 days.

(21) Appl. No.: 10/088,539

(22) PCT Filed: Sep. 21, 2000

(86) PCT No.: PCT/FI00/00804

§ 371 (c)(1),
(2), (4) Date: Mar. 19, 2002

(87) PCT Pub. No.: WO01/21312

PCT Pub. Date: Mar. 29, 2001

(30) Foreign Application Priority Data

Sep. 21, 1999 (FI) ..... 19992010

(51) Int. Cl.
*D21C 3/22* (2006.01)
*B02C 1/00* (2006.01)
*B02C 7/00* (2006.01)

(52) U.S. Cl. ..... 162/57; 162/4; 162/56; 162/52; 241/21

(58) Field of Classification Search ..... 162/20, 162/24–28, 56–57, 243, 52, 246, 4–8; 241/28, 241/245, 261.2, 261.3, 296–298, 21; 366/219–220
See application file for complete search history.

(56) References Cited

U.S. PATENT DOCUMENTS 4,865,690 A * 9/1989 Bernard et al. ..... 162/4
5,730,376 A * 3/1998 Schneid et al. ..... 241/245
5,733,412 A * 3/1998 Markham et al. ..... 162/6

(Continued)

FOREIGN PATENT DOCUMENTS

EP 0886001 12/1998

(Continued)

OTHER PUBLICATIONS

"Altpapier—Probleme der Thostoff-Ruckgewinnung bei der Beschaffung, bei der Aufbereitung und beim Einsatz", pp. 3-37, from Wochenblatt, 1976.

(Continued)

*Primary Examiner*—José A Fortuna
(74) *Attorney, Agent, or Firm*—Alfred A. Fressola; Ware, Fressola, Van Der Sluys & Adolphson LLP

(57) ABSTRACT

The object of the invention is a method and a device for dispersing pulp, especially pulp containing waste paper, in which method ground pulp mass is fed between the blade surfaces (4) of a dispersing device that are brought in a rotating movement in relation to one another. The invention is characterized in that the dispersing event takes place in a narrow opening (5) between the conical surfaces (3) at the outlet end (6) of which there is arranged a running wheel (7) acting as pump by which the pulp is pumped out of the dispersing device by centrifugal force. The inner cone of the dispersing device may act as rotor and the outer cone may act as stator. In addition, the pulp may be diluted at the outlet end of the blade opening (5) with fluid introduced to the intake side of the running wheel (7).

12 Claims, 2 Drawing Sheets

U.S. PATENT DOCUMENTS

| | | | | |
|---|---|---|---|---|
| 5,863,120 | A * | 1/1999 | Gallagher et al. | 366/171.1 |
| 6,077,396 | A * | 6/2000 | LaRiviere | 162/243 |
| 6,139,685 | A * | 10/2000 | Saito | 162/55 |
| 6,363,601 | B1 * | 4/2002 | Schneid | 29/436 |
| 6,419,786 | B1 * | 7/2002 | Kurtz | 162/4 |
| 6,811,655 | B1 * | 11/2004 | Haffner | 162/261 |

FOREIGN PATENT DOCUMENTS

| | | | |
|---|---|---|---|
| EP | 0922495 | | 6/1999 |
| EP | 0931584 | | 7/1999 |
| JP | 08099047 | A * | 4/1996 |
| SE | 441758 | | 11/1985 |
| SE | 502906 | | 2/1996 |
| WO | 96/12062 | * | 4/1996 |
| WO | WO 0121312 | A1 * | 3/2001 |

OTHER PUBLICATIONS

Cellwood Machinery brochure, Krima Dispenser Type KD.

* cited by examiner

METHOD FOR PROCESSING PULP

TECHNICAL FIELD

The object of the present invention is directed to a method and device for dispersing pulp, especially pulp containing waste paper, that also contains solid material and a liquid phase in which method ground pulp mass is fed between the blade surfaces of a dispersing device that are brought in a rotating movement in relation to one another.

BACKGROUND OF THE INVENTION

Pulp is treated in a dispersing device where the impurities of the pulp are separated from the fibers that are nevertheless not damaged in the treatment. This may be accomplished with the aid of mutually opposed blade equipped blade surfaces of the dispersing device where one blade surface along its base (stator) is fixed and the other blade surface along its base (rotor) is rotating in relation to the other blade surface. The blades and the narrow openings between them cause the pulp to move back and forth in the dispersing device, whereby separation of impurities from the fibers is accomplished. The purpose of dispersing is usually mechanical release of impurities from the fibers and simultaneously the grinding of impurities into smaller particles without nevertheless negatively affecting the properties of the fibers.

A dispersing device is especially well suited for treatment of pulp mass containing waste paper that contains ink particles or impurities such as adhesives and melt or fusion coatings. A method and dispersing device intended to treat this kind of pulp is presented in Patent Publication SE 502906. In the publication there is presented a grinding element that consists of two mutually opposed grinding disks that are equipped with elevated indents. The inclined elevated patterns are arranged radially on the disks.

In addition to the planar dispersing devices even cone-shaped dispersing devices may be used. However, the problem with the conical dispersing devices is the small amount of mass transferring power allowed by them. Therefore when the pressure in the outlet chamber is high, that is, in the openings between the indents, the thrust is high, and adjusting the working faces becomes more difficult and the load of the dispersing device increases. The dispersing device may even become clogged, whereby the process in interrupted. This problem is avoided by using the inventive method.

SUMMARY OF THE INVENTION

In the method according to the invention pulp, especially pulp containing waste paper, is dispersed in a blade opening between cone-shaped surfaces to the outlet end of which is arranged a running wheel acting as a pump by which the pulp is pumped with the aid of centrifugal force out of the dispersing device.

In the method according to the invention a conical dispersing device is used, the advantage of which is a wide working area. Hereby the outer cone preferably acts as stator and the inner cone preferably acts as rotor, onto which is additionally fixed a running wheel. The running wheel is most suitably fixed onto the cone acting as rotor such that it diverts the flow of mass away from the axis of the cone. Most preferably the running wheel is perpendicular to the axis of the cone such that the flow is in a perpendicular plane with regard to the axis. The advantage of a conical dispersing device in regard to a planar dispersing device lies in that blade surface area may be raised 50-150% in relation to a planar dispersing device, whereby the probability of the blade meeting an impurity increases considerably and the efficiency of the dispersing event is improved.

In the method according to the invention the function of the blade surfaces of the dispersing device may be adjusted and regulated by decreasing the pressure in the outlet area of the dispersing device, that is the outlet pressure of the device. The outlet pressure of the dispersing device may be adjusted lower than the pressure in the outlet chamber of the dispersing device by connecting a running wheel onto the rotor of the dispersed device. It is possible to decrease the outlet pressure to such a low value that the pressure at the end of the blade area is lower than in the beginning of the blade area, whereby suction is created towards the end area, whereby problems arising due to the low transferring power of the traditional cone-shaped dispersing device are avoided. When using the inventive method the probability of clogging of the dispersing device is thus low. From the above it follows even that when using the inventive method the blades of the working surfaces of the dispersing device may be mounted at closer distances to one another, whereby the number of the blades is increased, whereby the efficiency and productivity of the dispersing event are further improved.

In the inventive method the pressure at the inlet of the blade area, that is the inlet pressure, may be even considerably lower than the pressure in the outlet chamber of the dispersing device, into which the running wheel pumps the pulp. Hereby the pressure in the outlet chamber may be raised to such a high level that the pulp once dispersed may be transferred through the piping and to an even higher level than the dispersing device without a separate pump. In this way the inventive method can replace a method, in which a combination of a dispersing device, a pump, a feed tank for the pump and in some cases a screw conveyor is used. Further by the method according to the invention a high efficiency and productivity of the dispersing device are accomplished along with transfer of the pulp to the next stage of the process as well as if need may be, a hydrostatic pressure of the pulp that is sufficiently high for the next stage of the process. Thus the inventive method has a lower energy consumption than traditional methods.

The hydrostatic pressure for pumping of the pulp further to the next piping can be produced with the dispersing device or with separate pumping equipment. Pumping in the outlet area of the dispersing device is accomplished with the aid of a running wheel situated at the outlet end of the blade opening and of which there may be several in the device. In the method, dispersing and pumping are thus realized in separate parts of the device, whereby they do not interfere with each other.

In the method according to the invention, pulp may in addition be diluted at the outlet end of the blade opening with fluid introduced to the intake side of the running wheel. Thus the pulp may be diluted for the next process, if need be, without a separate work stage. In the outlet chamber mixing is sufficient to cause efficient dilution without a separate mixing means. The dilution fluid that may be pressurized or not, is introduced to the intake side of the running wheel through a feed channel of which there is at least one in the device.

Also, an object of the invention is a dispersing device for dispersing pulp, especially pulp containing waste paper, that contains solid material and a liquid phase. The dispersing device according to the invention comprises mutually opposed conical surfaces equipped with blades which may be brought in a rotating movement in relation to one another, an inlet channel for introducing pulp into the blade opening between the rotating surfaces as well as an outlet chamber for removal of the dispersed pulp. The dispersing device is characterized in that its blade surfaces are conical and that it comprises in addition a running wheel situated at the outlet end of the blade opening.

As stated above, according to the invention a conical dispersing device is used as dispersing equipment, the advantage of which is a wide working area. Hereby the outer cone preferably acts as a stator and the inner cone preferably acts as a rotor, onto which is additionally fixed a running wheel. The running wheel is most suitably fixed onto the cone acting as a rotor such that it diverts the flow of mass away from the axis of the cone. The advantage of a conical dispersing device in regard to a planar dispersing device lies in that the number of blades may be raised 50-150% in relation to a planar dispersing device, whereby the probability of the blade meeting an impurity increases considerably and the efficiency of the dispersing event is improved.

Further in addition to the above, the following advantages among others are realized by a conical dispersing device: in dispersing impurities higher efficiency than with a planar dispersing device is realized if both are operated at the same energy level; breaking of pulp fibers is reduced because energy is distributed on a greater number of blades, whereby a higher energy level than with a planar dispersing device may be used without nevertheless damaging the fibers; the service life of the blades of the dispersing device is increased because the working surface area is larger and hence the relation energy/blade lower.

The blade surfaces of a conical dispersing device may be at an angle of 10-75° in relation to the axis of the cone, preferably at an angle of 10-30° in relation to the axis of the cone. The blade surfaces may also consist of cylindrical surfaces and conical surfaces that are in extension to one another, however, it is preferred that the blades are mainly situated on conical surfaces. The blades are arranged on the moving blade surface (rotor) and on the fixed blade surface (stator) such that the blades are overlapping one another. The shape of the blades may be chosen at will, but their size must be such that the rotor and the stator form a pair in which the blades overlap.

The flow channels of the running wheel are designed such that the pressure increases towards the outer circumference of the running wheel (cf. a centrifugal pump). A high pressure in the flow channels and at their outlet openings stops the pulp from flowing back from the outlet chamber to the blade area. Between the running wheel and the outlet chamber wall there is a narrow opening that makes it possible for the running wheel to move freely but not for the pulp to flow back or for the pressure to drop in the outlet chamber.

BRIEF DESCRIPTION OF THE DRAWINGS

The invention is explained more in detail in the following with regard to the appended drawings in which:

FIG. 2 shows in addition the principle of the flow channels of the running wheel. The partial scheme is a cross section of the plane marked AA in FIG. 1.

BEST MODE FOR CARRYING OUT THE INVENTION

Figure 1:
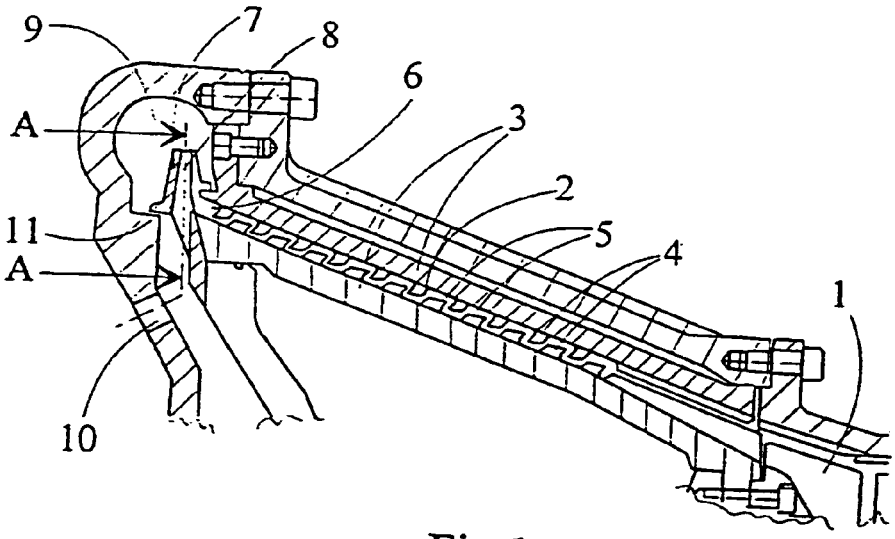
FIG. 1 is a partial longitudinal section of the dispersing device according to the invention.
Figure 4:
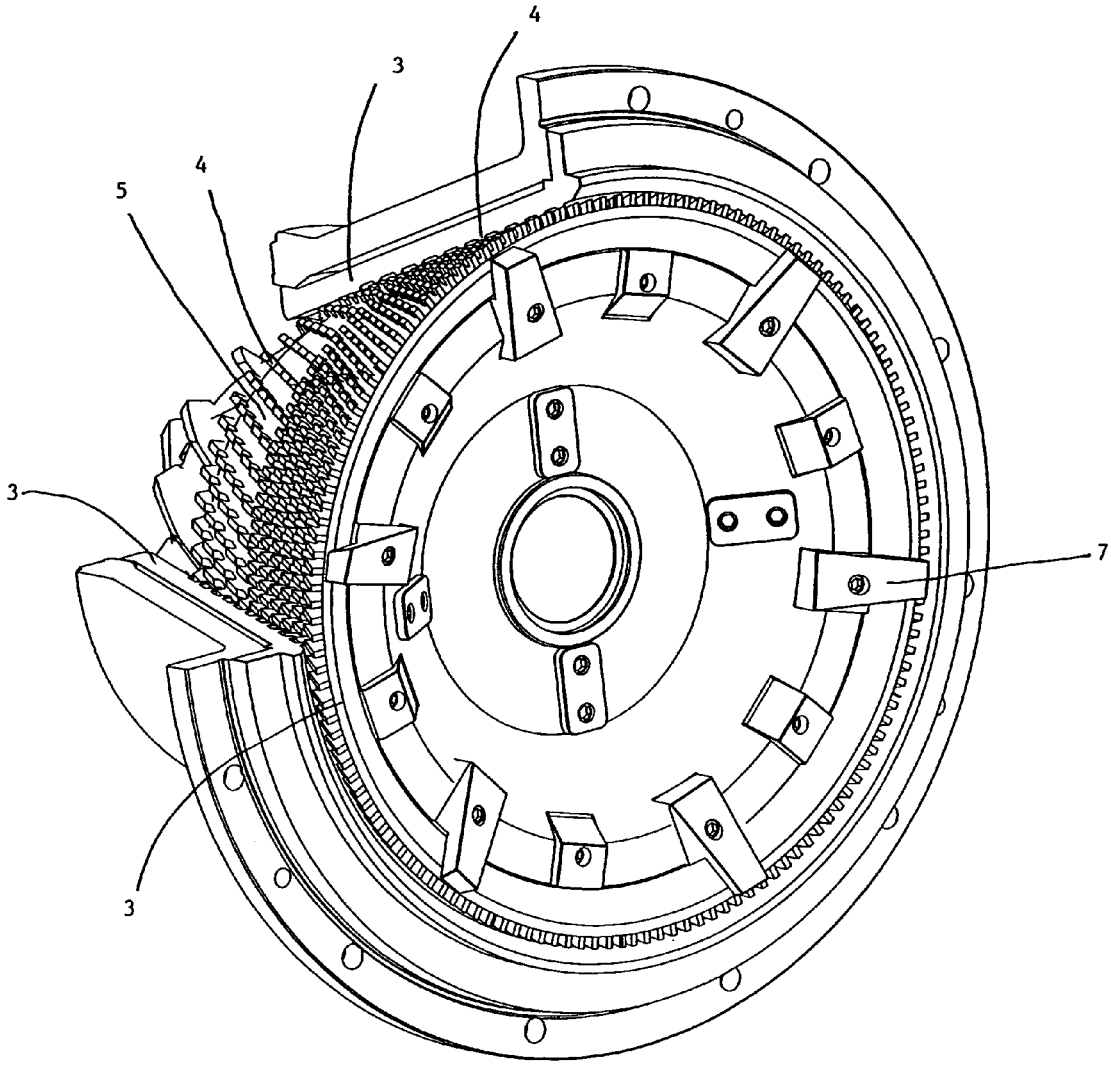
FIG. 4 is a perspective view of the disperser device shown in FIG. 1.

The conical dispersing device presented in FIG. 1 consists of a body part, a cone that includes the conical surfaces, of a running wheel and of an outlet chamber. The components in FIG. 1 are: 1 a feed point; 2 a cone; 3 conical surfaces; 4 a blade; 5 a blade opening; 6 and outlet point; 7 a running wheel; 8 a flow channel of the running wheel; 9 an outlet chamber; 10 a feed channel of the dilution fluid; 11 a narrow opening. FIG. 4 is a perspective view of the conical dispersing device.

The pulp that contains waste paper and the density of which is suitably 15-35%, is introduced to the conical dispersing device at the feed point 1. The pulp moves back and forth on the conical surfaces 3 in the narrow openings 5 of the blades 4 while it is simultaneously transferred forwards on the cone 2. The negative pressure created at the outlet point 6 of the blade area increases the mobility of the pulp forwards towards the outlet point 6. In the blade area impurities of the pulp are separated mechanically from the fibers of the pulp, in addition to which the impurities are ground into smaller particles.

As the pulp moves on to the outlet point 6 of the blade area it is blended with the dilution fluid that is introduced to the outlet point 6 through a feed channel 10 for the dilution fluid. The dilution fluid may be pressurized or not. As the running wheel 7 revolves a flow is created and the pulp is blended in the dilution fluid. The revolving motion also accomplishes the differing pressures between various parts of the device mentioned above. The diluted pulp is transferred through flow channels 8 of the running wheel according to the principle presented in FIG. 2 to the outlet chamber 9. In the outlet chamber 9 the density of the pulp is suitably 4-12%.

Figure 2:
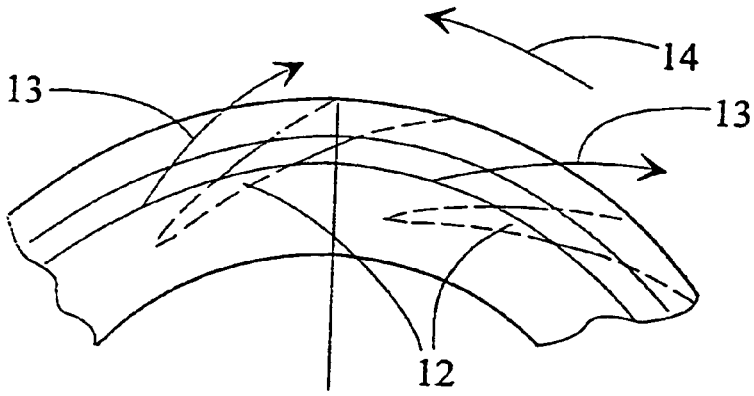
FIG. 2 presents a partial scheme of the structure and flow channels of the running wheel of the dispersing device presented in FIG. 1.

FIG. 2 presents a partial scheme of the structure of the running wheel 7 and of the flow channels 8 as well as the principle of the flow channels 8 of the running wheel. The partial scheme is a cross section of the plane marked AA in FIG. 1. The running wheel 7 has flow channels 8 that protrude axially outwards and are outlined by dashed lines 12. The flow of pulp 13 is away from the axis of the running wheel 7 in a direction opposite to the direction of rotation 14 of the running wheel 7. The running wheel 7 is mounted on the rotor in such a way that the direction of the flow of mass 13 changes in relation to the axis of the cone.

Between the running wheel 7 and the wall of the outlet chamber 9 there is a narrow opening 11 that makes it possible for the running wheel 7 to move freely but not for the pulp to flow backwards or for the pressure to decrease in the outlet chamber.

Figure 3:
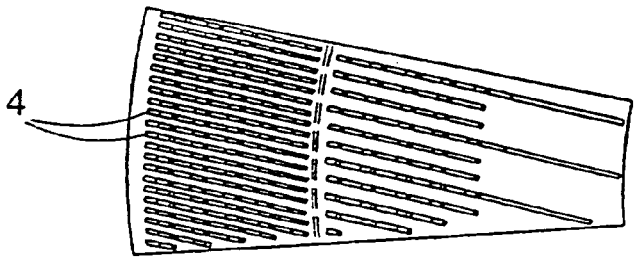
FIG. 3 presents the structure of the blade surface of the dispersing device according to FIG. 1.

In FIG. 3 is presented the arrangement of the blades 4 on the conical surface 3. The blades may be parallel with the conical surface lines or at a certain angle thereto, and their shape and mutual distance may be varied at will, as may be the blade patterns in various zones.

To a person skilled in the art it is obvious that the inventive method and the inventive device for dispersing pulp are not limited to the example presented above while they are based on the following claims.

The invention claimed is:

1. A method for dispersing pulp, that contains solid material and a liquid phase, in which method ground pulp mass is fed between two conical surfaces (3) with protruding blades (4) of a dispersing device, wherein the conical surfaces (3) with the protruding blades (4) are brought in a rotating movement in relation to one another, characterized in that the dispersing event takes place in a narrow opening (5) between the conical surfaces (3) with the protruding blades (4), at an outlet end (6) of which there is arranged at least one running wheel (7) attached to one of said two conical surfaces, said at least one running wheel shaped so as to protrude within an outlet chamber (9) and thereby act as a pump by which the pulp is pumped out of the dispersing device by centrifugal force.

2. A method according to claim 1, characterized in that one of the conical surfaces acts as rotor and the other conical surface acts as stator.

3. A method according to claim 2, characterized in that said at least one running wheel (7) is fixed on the one of the conical surfaces acting as a rotor in such a way that it diverts the flow of mass away from the axis of the cone.

4. A method according to claim 3, characterized in that the pulp is diluted at the outlet end (6) of the blade opening (5) by fluid introduced to an intake side of the at least one running wheel (7).

5. A method according to claim 4, characterized in that the consistency of the pulp to be dispersed is before dilution 15-35%.

6. A method according to claim 5, characterized in that the consistency of the pulp after dilution is 4-12%.

7. A method according to claim 6, characterized in that the pulp containing waste paper is dispersed in order to release printing ink and/or impurities from the fibers of the pulp.

8. A method according to claim 1, characterized in that the pulp is diluted at the outlet end (6) of the blade opening (5) by fluid introduced to an intake side of the at least one running wheel (7).

9. A method according to claim 8, characterized in that the consistency of the pulp to be dispersed is before dilution 15-35%.

10. A method according to claim 8, characterized in that the consistency of the pulp after dilution is 4-12%.

11. A method according to claim 1, characterized in that the pulp containing waste paper is dispersed in order to release printing ink and/or impurities from the fibers of the pulp.

12. The method according to claim 1 wherein each of the at least one running wheel (7) has at least one flow channel (8) formed therein that is arranged so that the pulp is transferred through said at least one flow channel.

* * * * *